US005143179A

United States Patent [19]

Hornstein

[11] Patent Number: 5,143,179

[45] Date of Patent: Sep. 1, 1992

[54] LIFTING HOIST FOR MOTOR VEHICLES

[75] Inventor: Roland Hornstein, Pfaizgrafenweiler, Fed. Rep. of Germany

[73] Assignee: Franz Hornstein GmbH & Co. KG, Fed. Rep. of Germany

[21] Appl. No.: 676,961

[22] Filed: Mar. 28, 1991

[30] Foreign Application Priority Data

Mar. 29, 1990 [DE] Fed. Rep. of Germany ... 9003685[U]

[51] Int. Cl.[5] ..... B66F 7/20

[52] U.S. Cl. ..... 187/8.41; 254/89 H; 254/93 VA

[58] Field of Search ..... 187/8.41, 8.47, 8.5, 187/17; 254/89 H, 32, 93 R, 93 VA, 423; 91/6, 46; 92/174, 153, 154, 156

[56] References Cited

U.S. PATENT DOCUMENTS

| | | | |
|---|---|---|---|
| 844,488 | 2/1907 | Weber | 91/46 |
| 1,919,156 | 7/1933 | Banning, Jr. | 254/93 |
| 1,982,701 | 12/1934 | Smith | 91/46 |
| 2,593,630 | 4/1952 | Thompson | 187/8.47 |
| 2,750,004 | 6/1956 | Harrison | 187/8.5 |
| 3,279,562 | 10/1966 | Farrell | 187/8.41 |
| 3,338,334 | 8/1967 | Matthews | 187/8.59 |
| 3,934,680 | 1/1976 | Bishop | 187/8.5 |
| 4,217,972 | 8/1980 | Jones | 187/8.41 |
| 4,572,480 | 2/1986 | Heintzmann et al. | 254/93 R |
| 4,815,718 | 3/1989 | Kadis | 91/46 X |

FOREIGN PATENT DOCUMENTS

| | | |
|---|---|---|
| 1876198 | 9/1962 | Fed. Rep. of Germany . |
| 1883535 | 9/1963 | Fed. Rep. of Germany . |
| 1981560 | 12/1967 | Fed. Rep. of Germany . |
| 3027501 | 2/1982 | Fed. Rep. of Germany . |
| 8907280 | 9/1989 | Fed. Rep. of Germany . |
| 458178 | 9/1917 | France . |
| 461598 | 5/1950 | France . |
| 1290891 | 3/1962 | France . |
| 501217 | 2/1939 | United Kingdom . |

OTHER PUBLICATIONS

DAT 80 (Deutsche Automobil Treuhand GmbH), pp. 3 and 4 (1980).

*Primary Examiner*—D. Glenn Dayonan
*Assistant Examiner*—Dean A. Reichard
*Attorney, Agent, or Firm*—Baker, Maxham, Jester & Meador

[57] ABSTRACT

A lifting platform for motor vehicles consisting of a least one lifting cylinder arranged in a covered pit at whose upper end supporting elements for the motor vehicle are attached, a high-pressure unit for supplying pressurized oil to the lifting cylinder and a guide bushing for the lifting cylinder attached to supporting frame anchored in the foundation of the pit. A central rod mounted on the bottom of the pit projects into the lifting cylinder and is sealed with respect to the lower end of the lifting cylinder by a ring gasket and its upper end face forms a pressure face. In the inside wall of each guide bushing there is at least one lubricating channel which is in flow connection with the pressurized oil return line with each lowering stroke of the lifting cylinder or the lifting platform.

28 Claims, 2 Drawing Sheets

LIFTING HOIST FOR MOTOR VEHICLES

FIELD OF THE INVENTION

This invention concerns a lifting hoist for motor vehicles and more particularly relates to an improved hoist having motion controlling guides with an efficient lubricating system.

BACKGROUND OF THE INVENTION

Lifting platforms for motor vehicles are typically available in two standard designs. In the first configuration which is operated with medium or low hydraulic pressure, the lifting piston also forms the supporting piston. The cylinder which is connected to an oil supply is arranged in a pit and its upper end is mounted on a stationary supporting structure. The hoisting element is formed by a trunk piston that projects with its lower section into the oil-filled interior of the cylinder, and its piston rod has the supporting elements for the motor vehicle on the upper end. To guide and seal the trunk piston rod, a relatively long guide bushing is provided in the top end section of the cylinder, and its friction surface is subjected to forced lubrication by entrained oil with each ejection movement of the piston rod. In this design a relatively low surface wear on the piston road and especially the guide bushings is achieved due to the forced lubrication in the area of the guide bushing. However, disadvantages are high cost of production plus the size of the individual parts required such as pumps, valves, etc. Such a lifting platform in a two-cylinder design is described in publication DAT 80, page 4.

Lifting platforms of the second structure are operated with hydraulic high pressure and have a relatively narrow high-pressure cylinder on the inside that assumes the actual lifting work, and they have an outer supporting piston or supporting tube. With a single cylinder lifting platform described in publication DAT 80, page 3, a high-pressure cylinder that accomplishes the lifting work is coaxially positioned in the interior of the supporting tube. The hollow piston rod is attached with its lower end to the base plate of the pit and contains an internal pressurized oil line that opens through valves into the pressure space limited by the piston attached to the upper end of the piston rod on the one end, and on the other end it is limited by the cover plate of the cylinder. The supporting tube surrounds the high-pressure cylinder with a radial distance and is guided in a relatively long guide tube which is attached to the side wall or the cover frame of the pit. Two friction surfaces with an axial distance between them are provided on the guide tube, but they do not necessarily receive forced lubrication. The high-pressure cylinder is connected to a supply unit through pipelines arranged next to the supporting tube in the pit and connected to the internal pressurized oil line that runs in the hollow piston beneath the bottom plate. This known high-pressure lifting platform is less expensive to manufacture because of its compact individual parts. Because of lack of forced lubrication of the friction surfaces between the guide tube and the outside surface of the cylinder, however, the guide tube is susceptible to wear. Built-in lubrication chambers or droplet lubrication can improve the wear phenomena but are effective only for a limited period of time.

SUMMARY OF THE INVENTION

A major purpose of this invention is to create a high-pressure lifting platform for motor vehicles that will be of a technically simple design and having automatic regulation of the pressure lubrication of the friction surface between the guide bushing and the lift cylinder.

A stationary rod inside the lift cylinder has the function of a submerged piston and together with its upper end face forms a pressure face whose size determines the lifting force. The connection of the lubrication channels arranged in the guide bushing to the return line of the pressurized oil supply assures liquid lubrication of the friction surfaces with each lowering stroke without requiring any separate oil lubrication supply. The pressure prevailing in the hydraulic system with the lowering stroke is sufficient to assure a flow of lubrication into the channel of the guide bushings. The lifting platform according to this invention consists of only a few individual parts and has a long lifetime because the wear on the outside wall of the lifting cylinder and the guide bushing is reduced due to the automatic forced lubrication. Since the jacketed tube of the high-pressure cylinder also functions as a supporting element, the jacketed tube or supporting tube which is necessary with traditional lifting platforms of the high-pressure design can be eliminated. Furthermore, neither a jacketed tube bottom or cylinder bottom nor a head piece is needed. The apparatus according to this invention combines the advantages of low-pressure lifting platforms with the advantages of high-pressure lifting platforms without the known disadvantages typical of the high-pressure lifting platforms.

With a two-cylinder lifting platform the two lifting cylinders are preferably supplied with pressurized oil from a common high-pressure unit so the return line for the oil is connected via a branch line to the lubrication channel in each guide bushing. In order to assure smooth running of both lifting cylinders, the two lifting cylinders are connected permanently together at the lower end by a crossbar, and they are guided by means of roller bodies on the respective side wall of the pit. In conjunction with the two guide bushings that are stably supported on the supporting frame, synchronous operation of the two lifting cylinders is assured by the crossbar and the roller body guide, namely without the toothed rack coupling used in the past or other additional components.

An expedient design of this invention is characterized in that the pressurized oil supply is connected by a drag line to the lower end of the pressure space which is formed at one end by the ring seal and by the upper end plate of the respective lifting hoist. On the other hand, there is also the possibility of providing a longitudinal channel that opens into the pressure space, optionally through a nonreturn valve in the upper end face in the stationary rod, and then connects its lower opening to the high-pressure unit by a rigid line.

An alternative embodiment of this invention includes a rack and pinion mechanism which assures synchronous running and at the same time assures a mutual position locking of the two lifting cylinders while at the same time preventing one or the other lifting cylinders from lowering even by the smallest amount under long-term loads and without in any way restricting the above-ground working area by means of any components such as pinions.

BRIEF DESCRIPTION OF THE DRAWING

The objects, advantages and features of the invention will be more readily apparent from the following detailed description, when read in conjunction with the accompanying drawing, in which.

DESCRIPTION OF THE PREFERRED EMBODIMENTS

Figure 1:
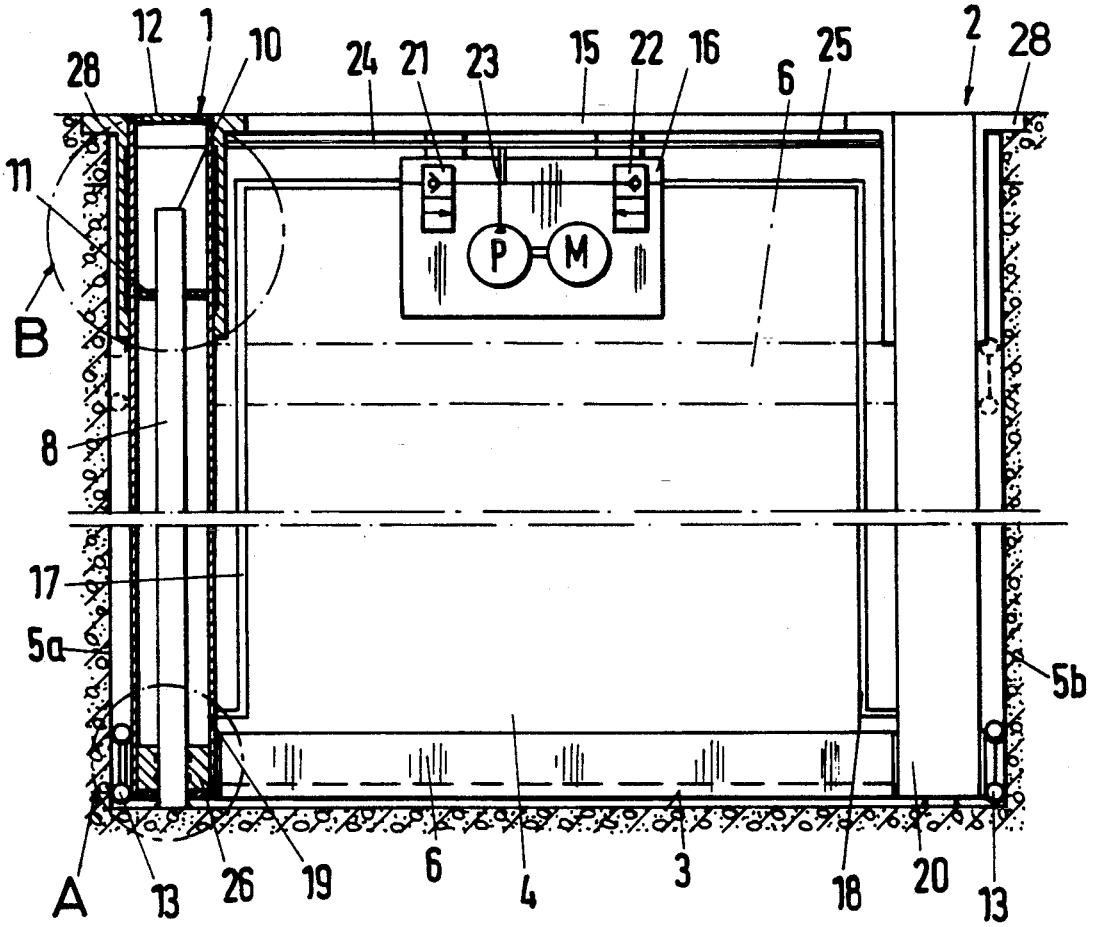
FIG. 1 is a schematic side view of a two-cylinder lifting platform installed in a pit according to the invention.

With reference now to the drawing, and more particularly to FIG. 1, twin lifting platforms for motor vehicles are driven by two lifting cylinders 1 and 2, which are arranged in pit 4. Bottom 3 and side walls 5*a* and 5*b* of the pit are all lined with rigid metal plates. The two lower ends of lifting cylinders 1 and 2 are connected to each other by crossbar 6 having a U-shaped cross section. In the interior of each lifting cylinder is rod 8 which is mounted with its lower end on bottom plate 3 or on a separate foot plate 9 (FIG. 3) which is secured to bottom plate 3. The upper end of rod 8 is free standing in the interior of the lifting cylinder where end face 10 forms a pressure face. Perforated spacer 11 can be arranged on rod 8 in the upper section and assures a central alignment of the rod in the respective lifting cylinder. The upper end of each lifting cylinder is sealed by cover plate 12, to which the supporting elements (not shown) for lifting the motor vehicle are bolted or otherwise mounted.

Figure 3:
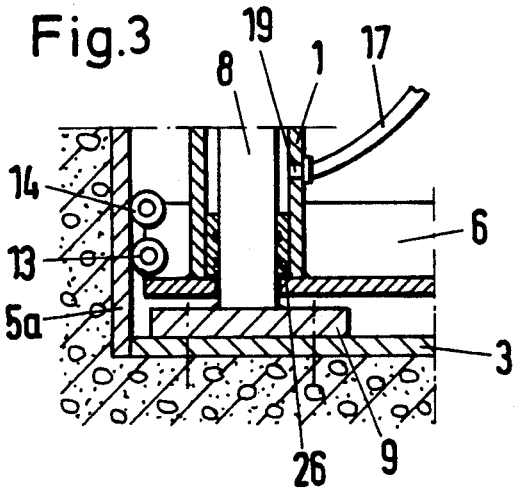
FIG. 3 shows area A in FIG. 1 on an enlarged scale.

As shown in FIG. 3, two running rollers 13 and 14 on each end of crossbar 6 roll on the inside surface of the respective side walls 5*a* and 5*b* in the respective hoisting or lowering stroke and thus guide the frame construction which is formed from the two lifting cylinders 1 and 2 and crossbar 6 along the side walls of the pit. Due to the use of the two running rollers which are stably mounted some distance apart, the side forces that occur can be absorbed much more effectively than with just one roller. With the total of four such rollers the result is a stable load rectangle that protects the entire lifting system against twisting or inclination and assures optimum smooth running.

Figure 2:
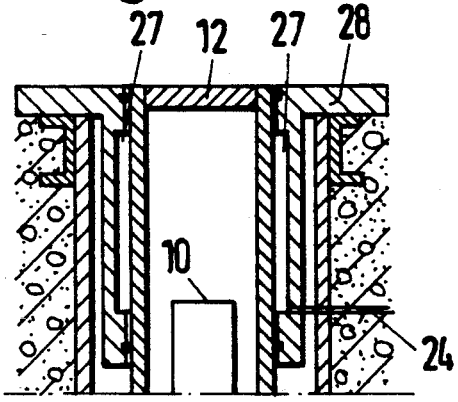
FIG. 2 shows area B in FIG. 1 on an enlarged scale.

As FIG. 1 shows, pump unit 16 is mounted on a cross support between lifting cylinders 1 and 2 under cover 15, and two pressure lines 17 and 18 lead in the form of drag lines or pressure hoses to connecting openings 19 and 20 in respective cylinders 1 and 2. Pump unit 16 pumps the liquid at a pressure of at least 90 bar through control and return valves 21 and 22 and pressure lines 17 and 18 into the respective interior of lifting cylinders 1 and 2, which are sealed at the top by cover plate 12 and at the bottom by annular ring gasket stopper 26. The ring gasket is attached to the lower end of the respective lifting cylinder, supported by a portion of crossbar 6 surrounding rod 8, and is in sliding contact with the outside wall of rod 8. Line 23 leads from pump unit 16 over branch lines 24 and 25 to annular lubricating spaces or channels 27 (FIG. 2) arranged on the inside surface of each guide bushing 28. Bushing 28 surrounds the upper end of retracted lifting cylinder 1 or 2, in which case fixed sealing rings on the inside wall of each guide bushing seal the respective pressure space toward the outside and with respect to lubricating channels 27.

The lubricating system is arranged so that when the pressure spaces of lifting cylinders 1 and 2 are under high pressure, lubricating lines 23, 24 and 25, and thus also lubricating channel 27 in guide brushings 28, are under no pressure. However, when the two lifting cylinders are in a lowering operation after turning off high-pressure unit 16, lubricating lines 23, 24 and 25 as well as the lubricating channel 27, receive oil from the return lines 17 and 18 (through valves 21 and 22) which are under a relatively low pressure. Since this process takes place with each lowering motion, the friction surfaces between guide bushing 28 and the lifting cylinders are adequately lubricated with the returning oil.

This invention is not limited to the embodiments described here, but instead, for example, the lubrication of the guide bushing can also be performed in a corresponding manner on a high-pressure single-cylinder lifting platform. Instead of two ring gaskets shown individually in FIG. 2 where they border a middle lubricating channel or lubricating space 27, it is also possible to provide several lubricating channels in each bushing 28. Preferably the two ring gaskets are arranged at the ends of the respective guide bushing in order to improve the guidance properties and obtain a sufficiently large separate lubricating space. With a suitably stable design of guide bushing 28, lubricating space 27 can be supplied by the pump unit with each lifting and lowering movement.

Figure 4:
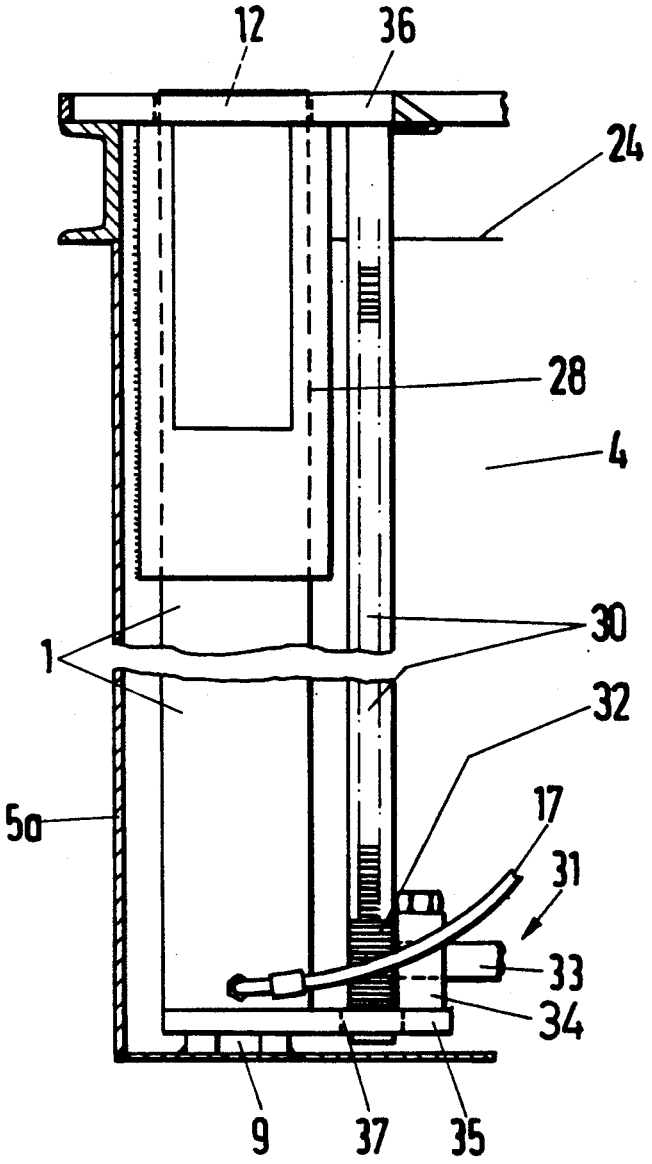
FIG. 4 is a partial view, similar to FIG. 1, showing an alternative embodiment of the invention.

FIG. 4 shows only a lifting cylinder of a two-cylinder lifting platform whose function corresponds in principle to that of the lifting platform shown in FIG. 1. The two versions have in common certain components that are labeled with the same reference numerals. In the lifting platform according to FIG. 4, concurrent running of lifting cylinders 1 and 2 is assured by a structurally simple synchronization mechanism replacing crossbar 6 which includes a toothed rack 30 assigned to each lifting cylinder, crossbar 31 that is attached to the lower ends of the two lifting cylinders and travels with them and two pinions 32 mounted on the crossbar 31, so they are constantly engaged with the respective stationary rack 30. The two racks 30 and pinions 32 have mating pitch teeth. As this shows, crossbar 31 consists of shaft 33 which extends horizontally between the two lifting cylinders in the pit and consists of two bearing blocks 34 which are attached to the lower sides of lifting cylinders 1 and 2 by connecting plates 35. Pinions 32 are mounted on the free end of shaft 33 that is mounted in bearing block 34.

Toothed racks 30 are mounted with their upper end on stable carrying plate 36 which is designed as an upper flange end of guide bushing 28 in the modification illustrated here. Connecting plates 35 have opening 37 in which rack 30 is loosely guided with the movement of the lifting cylinder. Bearing blocks 34 can also assume a certain guidance function through sliding contact with toothed rack 30. In the embodiment of FIG. 4, a roller guidance of the crossbars on the side walls of the pit is unnecessary because synchronized running and guidance of the two lifting cylinders is achieved through the synchronization of the racks and pinions. In comparison with known pinion synchronization devices, the essential advantage here is that the pinions, like the other components, are arranged in the pit and consequently do not affect the above ground working area. Furthermore, the walls of the pit need not be designed as accurately and with as much stability as in the FIGS. 1–3 embodiment because they do not have a guidance function. In special cases, however, any modifications according to FIGS. 1 and 4 can be combined either partially or completely, in which case only one roll can be provided per lifting cylinder. Under some circumstances, it is also possible to provide bilaterally acting roll guides on the two wide sides of the pit.

The hoisting platform described above has the following advantages. Rollers 13 and 14 on each end of crossbar 6 form bilateral double roller bearings to receive any unilateral loads. Side walls 5*a* and 5*b* together with bottom 3 form a completely preassembled watertight steel pan with which pit 4 is lined. Furthermore, no terminal switches are necessary but instead the hoisting movement is limited by hydraulic fixed stops. Additionally, in terms of installation and maintenance, it is advantageous that all details of the lifting platform are accessible from above after removing cover 15 and can be dismantled through this access.

In view of the above description it is likely that modifications and improvements will occur to those skilled in the art which are within the scope of the appended claims.

What is claimed is:

1. A lifting hoist for motor vehicles, said hoist comprising:

a pit having a foundation, side walls and end walls;

lifting cylinder means comprising at least one hollow lifting cylinder mounted in said pit and adapted to hold motor vehicle carrying apparatus on the upper end thereof, the interior of said lifting cylinder being open to pressurized fluid, the top end of said cylinder being sealed by a cover plate;

a high pressure unit for providing pressurized oil to said lifting means;

a supporting frame anchored in said pit on said foundation;

a guide bushing for each said lifting cylinder mounted to said frame;

a rod mounted to said foundation and generally axially projecting into each said lifting cylinder, the upper end of said rod and the inside facing surface of side cover plate forming opposed pressure surfaces for lifting said lifting cylinder;

means in the lower end of each said lifting cylinder for providing a sliding seal with respect to said rod;

at least one lubricating space formed between said lifting cylinder and said guide bushing;

first conduit means coupling said lubricating space with said high pressure unit; and means for supplying pressurized oil to said lubricating space pursuant to selected movement of said cylinder with respect to said rod.

2. The lifting hoist recited in claim 1, wherein said first conduit means comprises hose members and valves, whereby return flow fluid is supplied to said lubricating space upon each lowering stroke of said lifting cylinder.

3. The lifting hoist recited in claim 1, wherein said lifting cylinder means comprises two spaced lifting cylinders, the lower ends of which are rigidly connected together by a crossbar, and further comprising:

a pair of rollers secured to said lifting cylinders and engaging the sides of said pit for guiding up and down movement of said hoist.

4. The lifting hoist recited in claim 2, wherein said lifting cylinder means comprises two spaced lifting cylinders, the lower ends of which are rigidly connected together by a crossbar, and further comprising:

a pair of rollers engaging the sides of said pit for guiding up and down movement of said hoist.

5. The lifting hoist recited in claim 3, wherein said rollers are mounted on opposite ends of said crossbar.

6. The lifting hoist recited in claim 4, wherein said rollers are mounted on opposite ends of said crossbar.

7. The lifting hoist recited in claim 1, and further comprising second conduit means connecting the space in said lifting cylinder between said cover plate and said sliding seal means with said high pressure unit.

8. The lifting hoist recited in claim 2, and further comprising second conduit means connecting the space in said lifting cylinder between said cover plate and said sliding seal means with said high pressure unit.

9. The lifting hoist recited in claim 3, and further comprising second conduit means connecting the space in said lifting cylinder between said cover plate and said sliding seal means with said high pressure unit.

10. The lifting hoist recited in claim 5, and further comprising second conduit means connecting the space in said lifting cylinder between said cover plate and said sliding seal means with said high pressure unit.

11. The lifting hoist recited in claim 1, wherein said frame includes a cover and said guide bushing is formed with a flange to facilitate mounting of said guide bushing to said cover.

12. The lifting hoist recited in claim 1, wherein each said guide bushing comprises two spaced ring gaskets adjacent its ends, said ring gaskets longitudinally defining said lubricating space between said lifting cylinder and said guide bushing.

13. The lifting hoist recited in claim 2, wherein each said guide bushing comprises two spaced ring gaskets adjacent its ends, said ring gaskets longitudinally defining said lubricating space between said lifting cylinder and said guide bushing.

14. The lifting hoist recited in claim 3, wherein each said guide bushing comprises two spaced ring gaskets adjacent its ends, said ring gaskets longitudinally defining said lubricating space between said lifting cylinder and said guide bushing.

15. The lifting hoist recited in claim 1, wherein:

said lifting cylinder means comprises two spaced lifting cylinders, said hoist further comprising:

a stationary toothed rack mounted in said pit adjacent each said lifting cylinder;

a cross support extending between said toothed racks and rotationally mounted to and interconnecting said lifting cylinders at their lower ends, said cross support being configured with a pinion at either end synchronizingly engaging one of said toothed racks.

16. The lifting hoist recited in claim 2, wherein:

said lifting cylinder means comprises two spaced lifting cylinders, said hoist further comprising:

a stationary toothed rack mounted in said pit adjacent each said lifting cylinder;

a cross support extending between said toothed racks and rotationally mounted to and interconnecting said lifting cylinders at their lower ends, said cross support being configured with a pinion at either end synchronizingly engaging one of said toothed racks.

17. The lifting hoist recited in claim 7, wherein:

said lifting cylinder means comprises two spaced lifting cylinders, said hoist further comprising:

a stationary toothed rack mounted in said pit adjacent each said lifting cylinder;

a cross support extending between said toothed racks and rotationally mounted to and interconnecting said lifting cylinders at their lower ends, said cross support being configured with a pinion at either end synchronizingly engaging one of said toothed racks.

18. The lifting hoist recited in claim 11, wherein:

said lifting cylinder means comprises two spaced lifting cylinders, said hoist further comprising:

a stationary toothed rack mounted in said pit adjacent each said lifting cylinder;

a cross support extending between said toothed racks and rotationally mounted to and interconnecting said lifting cylinders at their lower ends, said cross support being configured with a pinion at either end synchronizingly engaging one of said toothed racks.

19. The lifting hoist recited in claim 12, wherein:

said lifting cylinder means comprises two spaced lifting cylinders, said hoist further comprising:

a stationary toothed rack mounted in said pit adjacent each said lifting cylinder;

a cross support extending between said toothed racks and rotationally mounted to and interconnecting said lifting cylinders at their lower ends, said cross support being configured with a pinion at either end synchronizingly engaging one of said toothed racks.

20. The lifting hoist recited in claim 15, wherein said cross support comprises a shaft arranged horizontally between said lifting cylinders and rotationally mounted thereto by means of bearing blocks mounted to said lifting cylinders by means of a connecting plate.

21. The lifting hoist recited in claim 16, wherein said cross support comprises a shaft arranged horizontally between said lifting cylinders and rotationally mounted thereto by means of bearing blocks mounted to said lifting cylinders by means of a connecting plate.

22. The lifting hoist recited in claim 17, wherein said cross support comprises a shaft arranged horizontally between said lifting cylinders and rotationally mounted thereto by means of bearing blocks mounted to said lifting cylinders by means of a connecting plate.

23. The lifting hoist recited in claim 18, wherein said cross support comprises a shaft arranged horizontally between said lifting cylinders and rotationally mounted thereto by means of bearing blocks mounted to said lifting cylinders by means of a connecting plate.

24. The lifting hoist recited in claim 19, wherein said cross support comprises a shaft arranged horizontally between said lifting cylinders and rotationally mounted thereto by means of bearing blocks mounted to said lifting cylinders.

25. The lifting hoist recited in claim 15, and further comprising a connecting plate secured to the bottom end of each said lifting cylinder, wherein each said toothed rack is connected at its upper end to said guide bushing, the lower end thereof being loosely guided in said connecting plate.

26. The lifting hoist recited in claim 20, wherein each said toothed rack is connected at its upper end to said guide bushing, the lower end thereof being loosely guided in said connecting plate.

27. The lifting hoist recited in claim 15, and further comprising a connecting plate secured to the bottom end of each said lifting cylinder, wherein each said toothed rack is connected at its upper end to a support plate on said guide bushing, the lower end thereof being loosely guided in said connecting plate.

28. The lifting hoist recited in claim 21, wherein each said toothed rack is connected at its upper end to said guide bushing, the lower end thereof being loosely guided in said connecting plate.

* * * * *